US005934787A

United States Patent [19]

Sharma

[11] Patent Number: 5,934,787

[45] Date of Patent: Aug. 10, 1999

[54] WALL OR PICTURE FRAME MOUNTED, BATTERY OPERATED, FLUORESCENT ILLUMINATING DEVICE

[76] Inventor: Murari Sharma, 15315 Chinaberry St., Gaithersburg, Md. 20878

[21] Appl. No.: 09/021,624

[22] Filed: Feb. 9, 1998

[51] Int. Cl.[6] ..... F21S 1/02

[52] U.S. Cl. ..... 362/147; 362/260; 362/217; 362/285; 362/287; 362/277; 362/280; 362/319; 362/322; 362/323; 362/282; 362/370; 362/371

[58] Field of Search ..... 362/147, 260, 362/217, 285, 287, 277, 280, 319, 322, 323, 282, 370, 371

[56] References Cited

U.S. PATENT DOCUMENTS

| | | | |
|---|---|---|---|
| D. 312,703 | 12/1990 | Muller et al. | D26/92 |
| 3,331,958 | 7/1967 | Adler . | |
| 3,475,603 | 10/1969 | Gheno | 362/183 |
| 3,723,720 | 3/1973 | Schmidt et al. | 362/183 |
| 3,786,245 | 1/1974 | Cincotta et al. | 362/183 |
| 4,268,894 | 5/1981 | Bartunek et al. | 362/158 |
| 5,165,783 | 11/1992 | Barron, Sr. | 362/253 |
| 5,303,127 | 4/1994 | Kosann | 362/296 |

OTHER PUBLICATIONS

Exposures Catalog Spring 1995, p. 20. C. Rechargeable Picture Lamp.

Advent Cordless Picture Light back of packaging. (Made by House of Troy, Inc., Vermont, USA).

The Original Wireless Wonder back of packaging. (Model Number CL–70, Made by Our Own Lighting Corporation, California, USA).

*Primary Examiner*—Sandra O'Shea
*Assistant Examiner*—Ronald E. DelGizzi

[57] ABSTRACT

A picture illuminating device for mounting on the wall above the picture, or on the back of the picture frame. The device utilizes a fluorescent light tube to produce uniform lighting and is powered by conventional or rechargeable batteries which eliminates the requirement of electrical outlets and the spectacle of exposed electrical cords extending down the wall. The device is composed of a stem and a shade. The shade houses the fluorescent light tube, batteries and the electronic circuit that converts the direct current from the batteries to the alternating current required to power the fluorescent light tube. The shade includes a reflector which is configured to mount the fluorescent light tube and batteries so that the shade covers the fluorescent light tube adequately to prevent any glare from the front while presenting the look of a conventional, corded picture lamp.

9 Claims, 7 Drawing Sheets

WALL OR PICTURE FRAME MOUNTED, BATTERY OPERATED, FLUORESCENT ILLUMINATING DEVICE

BACKGROUND OF THE INVENTION

The present invention relates to an illuminating device used for lighting artwork such as paintings, photographs, tapestries, or for lighting bookcases or walls. More particularly, the present invention is a fluorescent picture lamp that is powered by batteries.

The present invention is comprised of two distinct parts:

a) a shade that houses batteries, a circuit needed to convert the dc power from the batteries to the ac power required to power a fluorescent light tube, said light tube being placed inside a reflector. The shade is designed to completely cover the fluorescent light tube from the front so that the light tube shines on the artwork without causing a glare in the eye of the person viewing the picture; and b) a bracket, that can either be attached at one end to the artwork or to the wall behind or above the artwork, the other end being attached to the shade so that the shade can be adjusted to illuminate the artwork from the front. Preferably, the bracket allows for the shade to be adjustable relative to the artwork in a lateral fashion to adjust the distance from the artwork to the shade, and also including a swivel to allow the shade to be adjusted to a proper angle.

Heretofore, varied picture lamps have been proposed, including ones that use fluorescent light tubes to attain a more uniform lighting of the picture and to cast a light whose color attributes are closer to the color attributes of natural sunlight than from an incandescent light. The more uniform lighting achieved by the use of a fluorescent light tube is due to the light being emitted from numerous points across the length of the light tube instead of from a single point source as is the case in an incandescent light. Fluorescent light tubes are also advantageous in that they illuminate the picture or artwork using an efficient lighting source that produces very little heat compared to incandescent lighting, thus being much less harmful to the artwork than the incandescent lights exemplified by U.S. Pat. Nos. 3,307,026 (Kramer); 3,475,603 (Gheno); 3,723,720 (Schmidt); 3,786,245 (Cincotta); D312,703 (Muller); and Exposures Catalog, Spring 1995, Page 20.

Picture lamps have also been proposed that are battery operated, such as the Advent Cordless picture light (Listed under "Other Publications" in the Information Disclosure Statement), that house the batteries in the same housing as the lamp, but this picture lamp uses an incandescent bulb where the light output/battery life are only about one fifth of the effciency of a lamp using a fluorescent light tube. Further, this picture lamp requires the user to pull the entire inside of the fixture out in order to access the plastic battery holder when the batteries need to be replaced.

Some fluorescent picture lamps that have been proposed heretofore (see U.S. Pat. Nos., 5,165,783 (Barron, Sr.) and 5,303,127 (Kosann)) are powered by conventional household electricity, along with a cord to be connected to the household electric line, or by being plugged into a household electric socket. The unsightliness of the power cord leaves the user with the choice of either masking the cord by covering it, which requires effort in installation and leaves a cord cover visible; or, the choice of going through the lengthy and difficult installation process of routing the wire behind the wall and also connecting the power to the cord from behind the wall.

Fluorescent light tubes powered by either conventional batteries or rechargeable batteries (see U.S. Pat. Nos. 3,331,958 (Adler) and 4,268,894 (Bartunek)) have also been proposed due to the much greater efficiency of the fluorescent lamp in applications that demand more light and more life from the use of a limited power source. However, these lamps have been made and configured for use as emergency lights or other uses where conventional household electricity is not available, such as in a light to be used while camping, and their configurations do not lend themselves to the lighting of pictures.

A fluorescent lamp has also been proposed that contains a space for batteries in the fixture with the lamp underneath this space such as the "The Original Wireless Wonder" (Listed under "Other Publications" in the Information Disclosure Statement), along with a mounting bracket that is attached to the side of the shade. This device is akin to a box (for the batteries), with a bare fluorescent light tube (although the light tube is covered, it is covered with a transparent piece of pastic) mounted to the underside of the said box. This aspect of the device makes it unsuitable for lighting pictures because the light from the light tube radiates equally in a forward direction as in a backward (toward the object to be lit) direction. The glare caused is particularly objectionable in the case of a picture lamp, where the end result is to light a picture with the least of other distractions to the eye. If the device is turned to have the light tube face the picture, the disadvantage of this device is that it casts an equal amount of light above as well as on to the picture (wasting half the light on the wall), and the mounting arm of the lamp creates a large shadow. This device also has the disadvantage of requiring the removal and installation of a screw in order to change the light tube.

A fluorescent picture lamp has also been proposed heretofore (see Great Britain Patent 1,561,543 (Jewson)), that is powered by batteries. A disadvantage of this picture lamp is that the batteries are received in a box that is hidden behind the picture, resulting in the picture being hung on the wall with a gap of at least approximately 1.5 inches between the wall and the picture frame. This gap causes a distinct decrease in the aesthetic appeal of a picture that utilizes such a picture lamp.

The inventor has also made application for a wall mounted picture lamp that uses batteries, (application Ser. No. 08/550,830) which is entirely different from the present invention in that it includes a box to hold the batteries, the box being mounted to the wall.

The present invention has the flexibility of being easily mounted either on the wall or on the picture frame, at the discretion of the user, after the user has assessed the type of wall and picture frame in question. The present invention also describes a means by which the light tube, in relation to the batteries, is located in a general horizontal direction rather than a vertical direction. This aspect of the invention is entirely new in that none of the prior art describes such an arrangement of batteries to light tube. The advantage of this arrangement is that the light tube can be recessed further into the housing, so that it causes no glare when viewed from the front, and causes minimal reflective glare from the picture surface, while at the same time provides for a minimal vertical profile to the shade when viewed from the front, so as to cause the least distraction from the picture to be viewed.

SUMMARY OF THE INVENTION

It is an object of the present invention to provide a picture lamp having a low profile which provides even illumination of artwork while providing very little heat on the same, and is efficiently powered by conventional or rechargeable batteries, and can be easily mounted.

It is also an object of the present invention to provide a picture lamp that illuminates artwork in the color temperature that is close to sunlight and lights the picture in closer to the same kind of color temperature it was painted in and was intended to be viewed.

Another object of the present invention is to provide a picture lamp that alternatively mounts to a wall above a picture, or to the back of a picture frame. The installation can be accomplished with ease requiring only screws that are anchored into a wall or picture frame using a screwdriver.

It is a further object of the present invention to provide a picture lamp that is easy to manufacture and operate.

Yet another object of the present invention is to provide a picture lamp where user replaceable parts, namely the batteries and the fluorescent light tube, are readily available at low cost. Both the batteries and the fluorescent light tube are readily and inexpensively available at hardware and other stores.

One more object of the present invention is to provide a picture lamp where the user replaceable parts, namely the batteries and the fluorescent light tube are easily replaced by the user, without the need for any tools. This is achieved by using an end cap on the end of the shade of the lamp that is easily removable to expel/replace the batteries. The end cap may include a spring contact to provide a connection for either the positive or negative end of the batteries.

Yet another object of the present invention is to provide a picture lamp where the shade contains both the batteries and the fluorescent light tube, where the shade covers the fluorescent light tube from the front so that no direct light from the fluorescent light tube is emanated towards the front (away from the picture). Further, for a picture lamp, the light from the reflection from the picture (usually covered by glass, adding to the reflection) needs to be minimized. This can be done by recessing the fluorescent light tube inside the shade adequately. Because of the abovementioned fact that a picture light should distract as little as possible from the picture it is lighting, it is advantageous to design the shade such that it presents the least possible vertical dimension when viewed from the front, while still recessing the fluorescent light tube as much as possible to avoid glare and reflection. It is also an object of the present invention to allow the fluorescent light tube to be maximally recessed into the shade while the shade presents the least vertical dimension when viewed from the front. This is achieved by arranging the batteries and fluorescent light tube horizontally with respect to each other rather than vertically as is the case in the "Advent Cordless picture light" or the "Original Wireless Wonder". One method of achieving a non-vertical arrangement for the batteries and the fluorescent light tube within the shade is to use a "question-mark" shaped reflector to mount the batteries and the fluorescent light tube within the shade and position the fluorescent light tube at a location, with respect to the batteries, of other than a vertical plane through the midsection of the batteries and the fluorescent light tube, (if the batteries were placed directly above the fluorescent light tube) as depicted in the description of the preferred embodiment.

Configurations other than a "question-marked" shape for a reflector may also achieve the same objects, for example by the use of an "L" shaped reflector where the sockets and fluorescent light tube are mounted on the vertical portion of the "L".

The objects of the invention are achieved by the provision of a picture lamp which is comprised of a bracket, and a shade that houses the conventional or rechargeable batteries, the fluorescent light tube and the electronic circuit that converts the direct current from the batteries to alternating current that is required to power a fluorescent light tube. The shade is attached to the bracket in a manner that positions the lamp at an angle whereby hanging artwork can be illuminated.

DESCRIPTION OF THE PREFERRED EMBODIMENT

Figure 1:
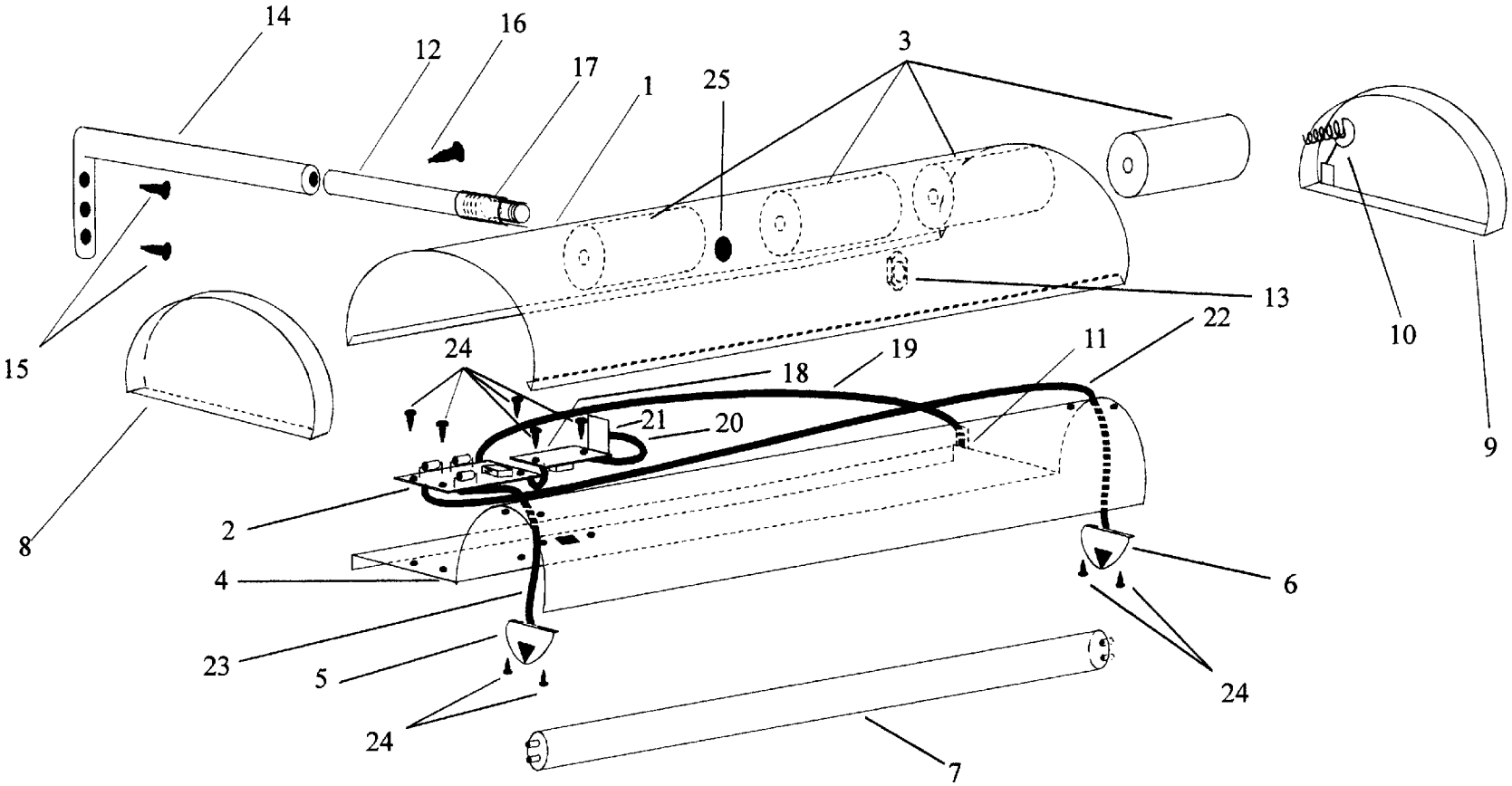
FIG. 1 is an exploded perspective view of the picture lamp.

Referring to FIG. 1, the picture lamp consists of a shade 1 of generally semi-tubular shape that houses the circuit 2 and batteries 3, a question mark shaped reflector 4 having a straight planar portion connected to a curved portion, the straight portion being designed to provide a hollow opening between the wall of the shade 1 and the straight portion, allowing for installation of batteries 3 and the mounting of the circuit 2 in the said hollow opening. The curved portion of the reflector 4 acts to hold in place the sockets 5, 6 required to hold and allow to be easily changeable, the fluorescent light tube 7. The shade 1 is enclosed on the ends by two endcaps 8, 9; with one of the endcaps 9 allowing for contact with either the positive or negative contact of the battery power, through the use of a spring 10 and a metal contact 11. The shade 1, the reflector 4 and the endcaps 8,9 are made of a resilient material which may be stamped, extruded or molded.

The shade 1 is attached to a stem 12 by the use of a nut 13 on the inside of the shade 1. The stem 12 fits through the shade 1 through a hole 25 in the shade 1. The stem 12 fits into the mounting bracket 14, and mounting bracket 14 is in turn mounted to a wall or the back of a picture frame by the use of screws 15. The stem 12 mates to the mounting bracket 14 in a manner that allows it to be adjustably positioned with respect to the mounting surface. A set screw 16 may be used to lock the the stem 12 and shade 1 at the desired distance from a surface 28. The shade 1 can be further positioned for an optimum angle of light delivery to a surface by adjustment of swivel adjustment 17 on the stem 12 using a universal tilt mechanism. The stem 12 and the mounting bracket 14 may be made of stamped, extruded or molded material. The picture lamp is operated by a switch 18 of simple on-off type.

The positive and negative current bearing wires 19, 20 lead from the respective positive and negative ends of the batteries from the contacts 11, 21 to the the positive and negative inputs of the circuit 2, the positive wire 19 or 20 leading through the switch 18. Two wires 22, 23 lead from the outputs of the circuit 2, are guided through the reflector 4, and are connected to the two sockets 5, 6 that hold and provide electrical contact to the fluorescent light tube 7. These sockets 5, 6 are also instrumental in providing a means for repaceability of the fluorescent light tube 7. The sockets 5,6, switch 18, circuit 2 and contacts 11 can be mounted on the reflector by the use of screws 24. The endcaps 8, 9 can be removed or mounted on the shade 1 by squeezing the shade 1 and sliding the endcaps 8, 9 on or off the shade 1. The resilience of the shade 1 will act to hold the endcaps 8, 9 in place.

Figure 2:
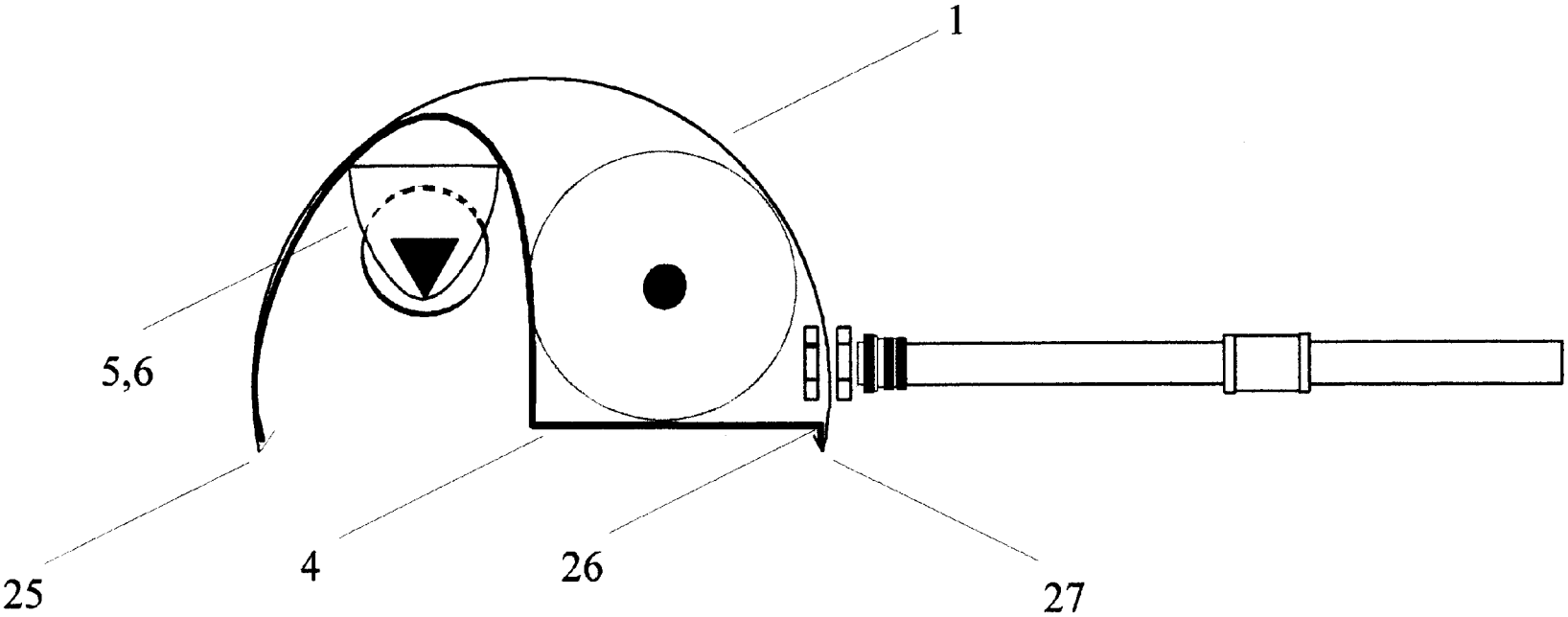
FIG. 2 is a side view depicting the lamp with the end cap removed.

Referring to FIG. 2, The reflector 4 can be bent at a right angle along one edge 26 to hold itself in place within the shade 1, which has a corresponding bend 27 to receive said reflector 4. The reflector has its other edge received in a second bend 25 formed in the corresponding edge of the shade 1. The batteries 3 can be placed in the opening created between the shade 1 and the reflector 4. The reflector 4 also holds in place the sockets 5,6 that provides the contact and means of interchangeability for the fluorescent light tube 7. The sockets 5,6 can be attached to the reflector 4 by screws 24.

Figure 3:
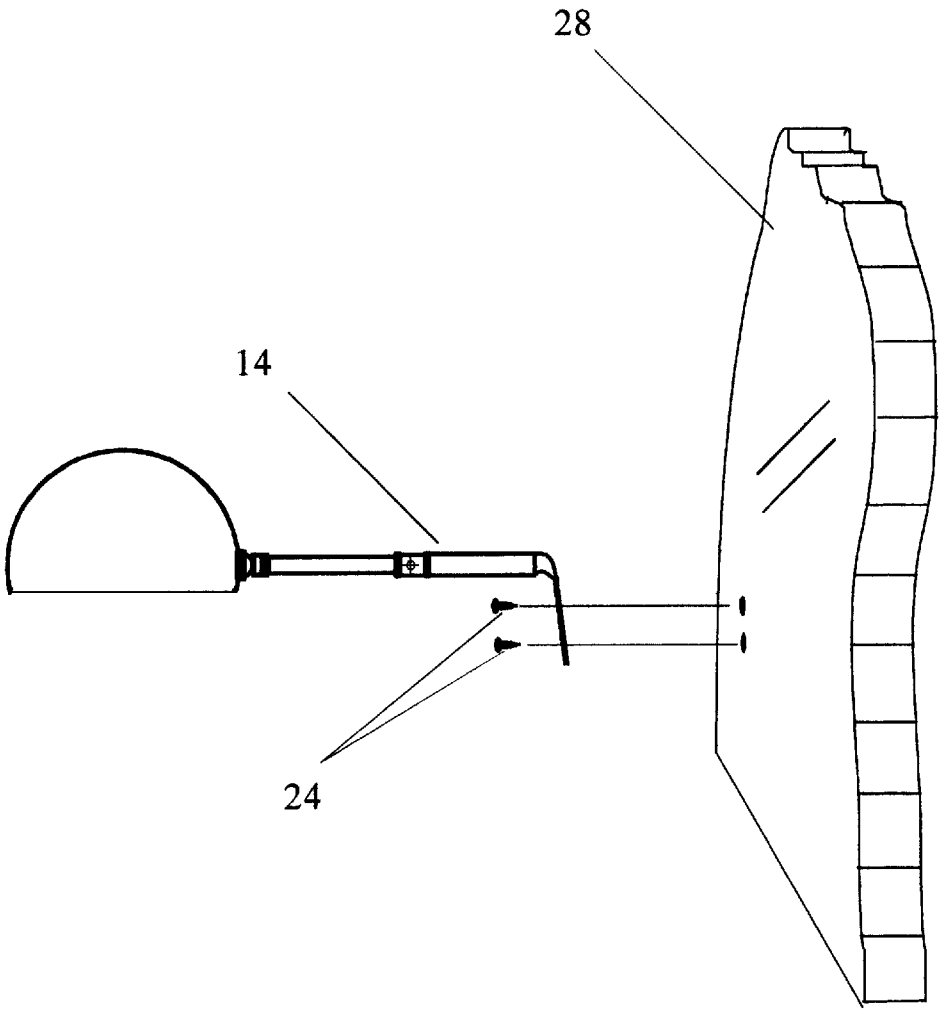
FIG. 3 is a side view of the lamp showing a method for mounting it to the wall.

Referring to FIG. 3, the mounting bracket 14 can be mounted to the wall 28 by the means of screws 24.

Figure 4:
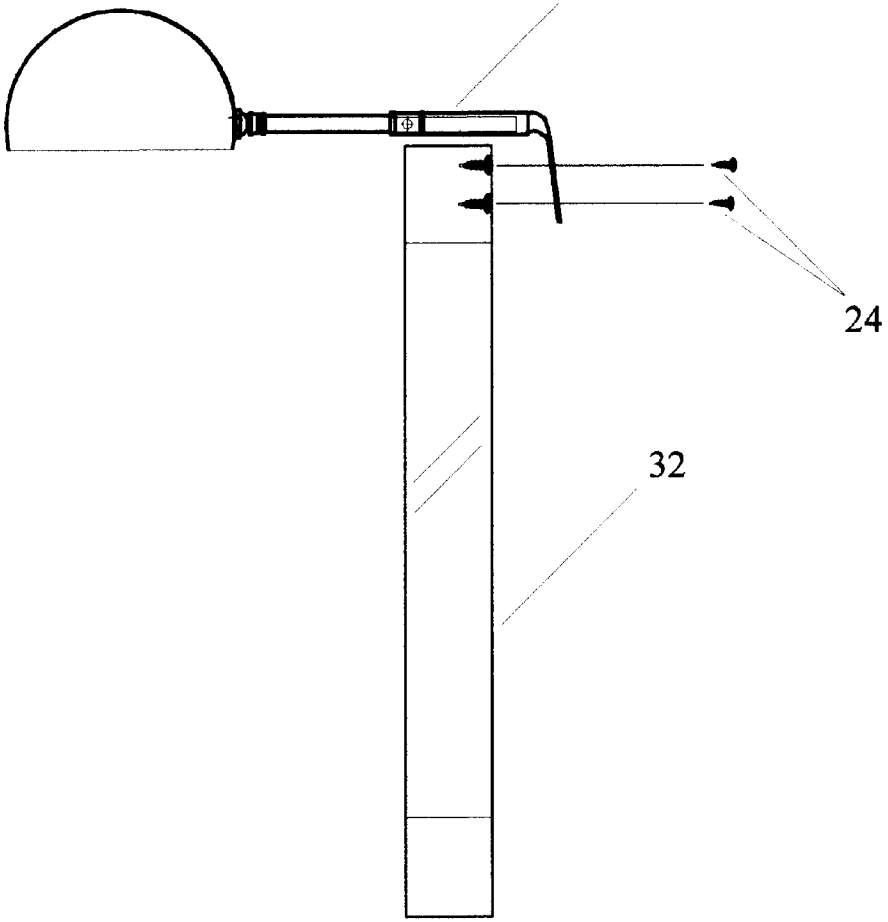
FIG. 4 is a side view of the lamp showing a method for mounting it to the back of a picture frame.

Referring to FIG. 4, the mounting bracket 14 can be mounted to the back of a picture frame 32 by means of screws 24.

Figure 5:
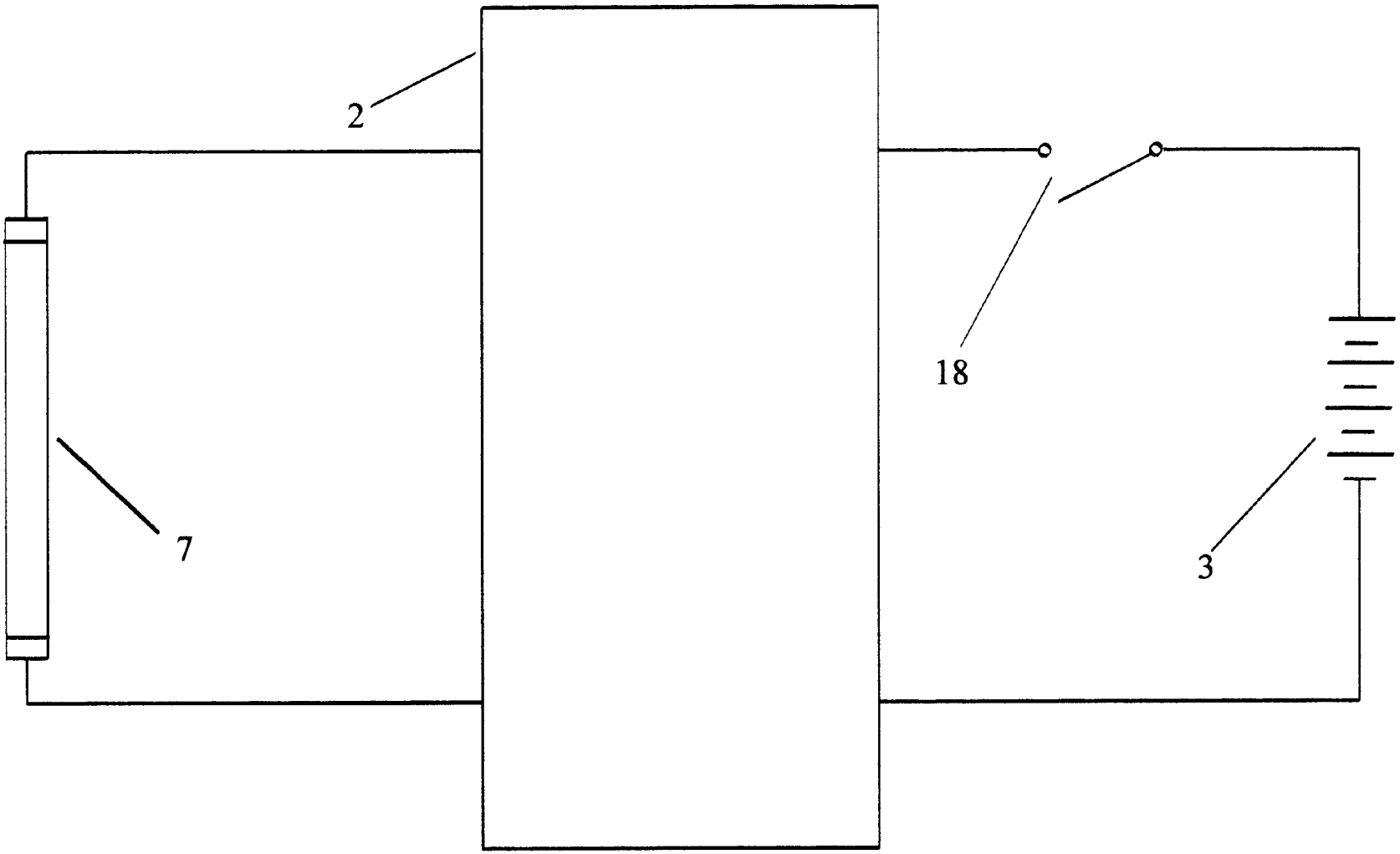
FIG. 5 is a circuit diagram of the picture lamp.

Referring to FIG. 5, the electrical circuit is comprised of a set of batteries 3 of conventional or rechargeable type where the positive output of the batteries 3 is connected to the switch 18. From the switch 18 is a connection to the positive input on the circuit 2. The output of the circuit 2 leads to the fluorescent light tube 7. The negative input of the circuit 10 is connected to the negative input of the batteries 3 to complete the circuit.

Figure 6C:
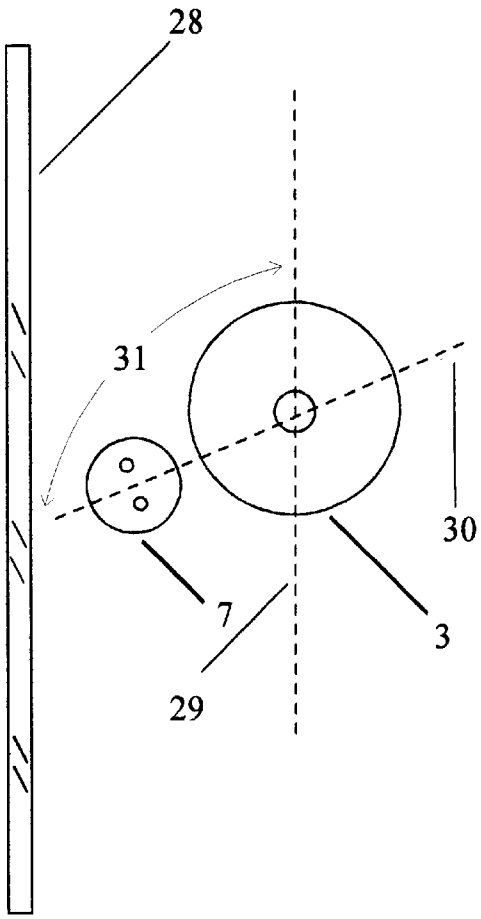
FIG. 6*c* is a side view of the present invention, showing the arrangement of the fluorescent light tube to the power source with the fluorescent light tube being rotated around the power source in a counter-lockwise direction from the position of the arrangement in the prior art.
Figure 6B:
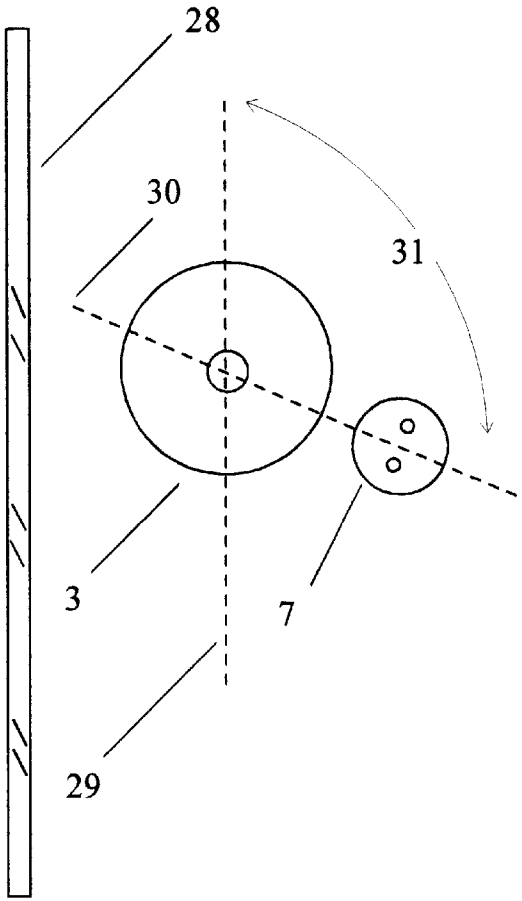
FIG. 6*b* is a side view of the present invention, showing the arrangement of the fluorescent light tube to the power source with the fluorescent light tube being rotated around the power source in a clockwise direction from the position of the arrangement in the prior art.
Figure 6A:
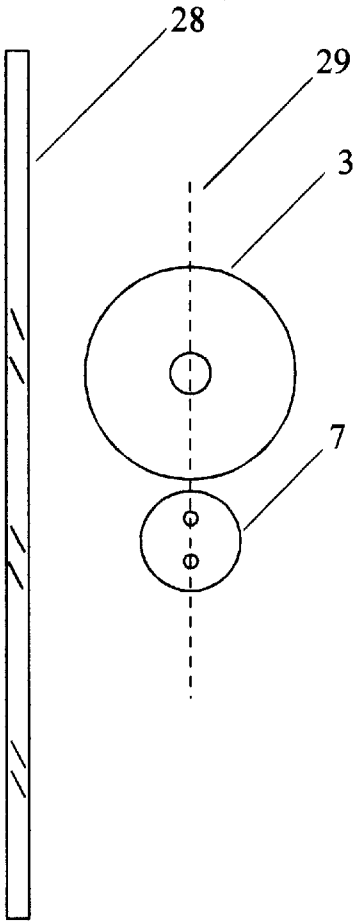
Figure 6a (Prior Art)
FIG. 6*a* is a side view of the picture lamp showing the arrangement of the fluorescent light tube to the power source in the prior art.

Referring to FIG. 6*a*, the battery 3 to fluorescent light tube 7 arrangement of the prior art is shown where a vertical wall 28 is depicted for reference of direction. The battery and fluorescent light tube are arranged with their respective axis in the vertical plane 29 through the midsections of the battery 3 and fluorescent light tube 7.

FIG. 6*b*, shows the battery 3 to fluorescent light tube 7 arrangement of the present invention where a vertical wall 28 is shown for reference of direction. The plane 30 goes through the midsections of the battery 3 and fluorescent light tube 7 forms an angle 31 with the vertical plane 29, which contains the midsection of the batteries, the fluorescent light tube 7 being moved around the battery 3 in a clockwise direction from the prior art position.

FIG. 6*c*, shows the battery 3 to fluorescent light tube 7 arrangement of the present invention where a vertical wall 28 is shown for reference of direction. The plane 30 goes through the midsections of the battery 3 and fluorescent light tube 7 forms an angle 31 with the vertical plane 29, which contains the midsection of the batteries, the fluorescent light tube 7 being moved around the battery 3 in a counter-clockwise direction from the prior art position.

Figure 7:
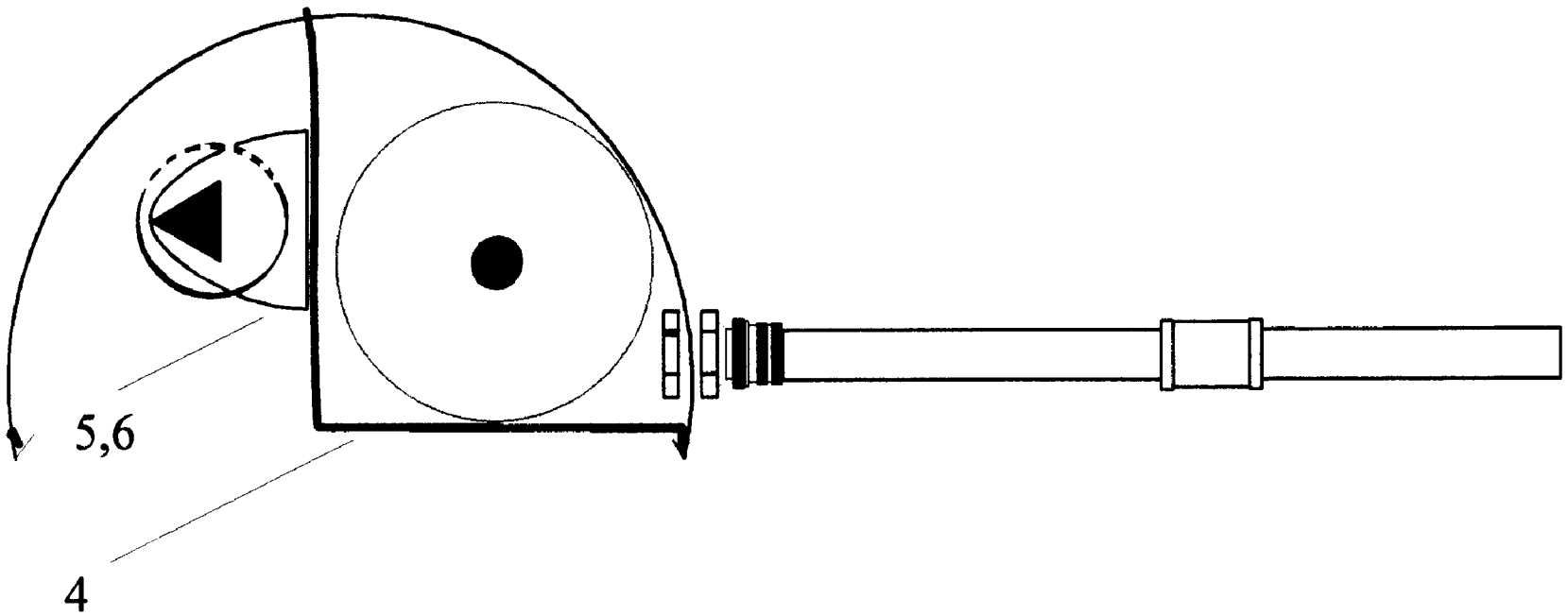
FIG. 7 is a side view of the present invention, showing the arrangement using an "L" shaped reflector.

Referring to FIG. 7, The reflector 4 can be "L" shaped with the sockets 5,6 mounted on the vertical portion of the "L" shaped reflector 4.

From the foregoing description it should be apparent that the present invention provides many features that are entirely new in a battery operated, fluorescent picture lamp. The invention combines the efficiency of a fluorescent light tube with a DC power source, whereby the physical arrangement between the power source and the fluorescent light tube allows for a lamp made with a minimum vertical dimension. This allows for a larger power source to be used than would be practical with the power source to fluorescent light tube arrangement of any of the prior art, thus allowing a longer battery life for the light, while allowing for the least obstruction of view of the art to be illuminated.

Obviously, the construction may be modified in some respects without departing from the spirit of the invention which is clearly spelled out in the claim. This could include other physical ways to house the fluorescent light tube and batteries in the desired configuration, such as a complete housing made of molded material, either painted on the outside surface or covered with a thin film of material of desired finish over the molded housing.

Alternatively, the batteries may be housed in a tube that fits into the space between the reflector and shade, the tube providing ease of insertion or removal of the batteries. Another alternative would be to mount a battery holder on to the reflector, and sliding out the entire reflector assembly in order to access the batter holder for insertion or removal of the batteries. The use of a battery holder may obviate the need for a spring contact on the end cap, assuming a contact is integral to the battery holder. The fluorescent light tube is similarly able to slide into appropriate sockets, and retained in the sockets by simply twisting the fluorescent light tube. Other means may be used for inserting and removing the batteries may also be used, such as the inclusion of a "door" at the bottom of the flat portion of the reflector, obviating the need for removing the end caps for the purpose of inserting or removing batteries.

The entire invention can be constructed of stamped, extruded or molded material and is provided with all of the features for placement necessary to illuminate hanging artwork.

What I claim is:

1. A wall or picture frame mounted, cordless illuminating device comprising:

a tubular stem having a first end and a second end;

a mounting bracket being formed with a first and second part; said first part adjustably receiving said first end of said tubular stem and said second part being removably mounted to a picture frame or a wall; and an elongated shade having a mid-section adjustably mounted to said second end of said tubular stem; said shade having a semicircular cross-section; said shade houses means for removably mounting at least one fluorescent light tube and a source of direct current on either side of a vertical plane cut through the ends of the semicircular shade, said shade further housing an electronic circuit for converting direct current to alternating current;

said means for mounting said fluorescent light tube being positioned within said shade relative to said source of direct current so that a plane which contains the midsection of said source of direct current and the mid-section of said fluorescent light tube makes an angle of at least ten degress but not more than one hundred and seventy degrees, in either a clockwise or counter-clockwise direction with the vertical plane.

2. The wall or picture frame mounted, cordless illuminating device of claim 1 wherein said shade further includes:

an elongated reflector having an arcuate portion and a planar portion which together have a generally question marked (?) shaped cross-sectional configuration; said reflector defines an enclosed space to house the means of direct current and an open space within said arcuate portion for mounting said means for mounting said fluorescent light tube.

3. The wall or picture frame mounted, cordless illuminating device of claim 2 wherein the reflector is formed with a unitary construction.

4. The wall or picture frame mounted, cordless illuminating device of claim 3 wherein the means for mounting said fluorescent tube comprises a pair of sockets connected in said electrical circuit and mounted at opposite ends of said open space of said reflector.

5. The wall or picture frame mounted, cordless, illuminating device of claim 4 wherein the planar portion of the reflector includes a surface for mounting a holder for retaining the source of direct current and for mounting said electronic circuit.

6. The wall or picture frame mounted, cordless, illuminating device of claim 5 wherein the source of direct current is a plurality of conventional batteries.

7. The wall or picture frame mounted, cordless, illuminating device of claim 5 wherein the source of direct current is a plurality of rechargeable batteries.

8. The wall or picture frame mounted, cordless, illuminating device of claim 1 wherein the stem is adjustably mounted to the shade by a universal tilt mechanism.

9. The wall or picture frame mounted, cordless, illuminating device of claim 1 wherein said axis of said elongate shade extends parallel to an upper edge of said upper edge of said picture frame.

* * * * *